United States Patent [19]

Burchett

[11] Patent Number: 5,033,134

[45] Date of Patent: Jul. 23, 1991

[54] CABINET WALL BED

[75] Inventor: Dale Burchett, New Albany, Ind.

[73] Assignee: Charles C. McConnell, Louisville, Ky.

[21] Appl. No.: 542,303

[22] Filed: Jun. 22, 1990

[51] Int. Cl.[5] ..... A47C 19/12

[52] U.S. Cl. ..... 5/133; 5/167; 5/159.1

[58] Field of Search ..... 5/133, 136, 167, 168, 5/164, 159

[56] References Cited

U.S. PATENT DOCUMENTS

| | | | |
|---|---|---|---|
| 219,078 | 9/1879 | Dupre | 5/167 |
| 269,985 | 1/1883 | Adgate | 5/167 |
| 330,373 | 11/1885 | Boyington | 5/167 |
| 411,641 | 9/1889 | Brown | 5/167 |
| 861,452 | 7/1907 | Freeland | 5/159.1 |

FOREIGN PATENT DOCUMENTS

| | | | |
|---|---|---|---|
| 678875 | 9/1952 | United Kingdom | 5/167 |

OTHER PUBLICATIONS

The Complete Hafele, pp. 2.59–2.61, published by Hafele America Company.

*Primary Examiner*—Eric K. Nicholson
*Attorney, Agent, or Firm*—Scott R. Cox

[57] ABSTRACT

A new and useful cabinet wall bed which contains a cabinet, a bed frame which is secured to the cabinet by a pivot bracket, a counterbalance piston and a unique leg-locking and supporting system. The bed frame is locked in its closed position by the leg-locking and supporting system wherein the leg-locking and supporting system is comprised of a combined handle and leg, a leg hinge, a locking bar, a compression spring support and an angle bar to engage the locking bar.

2 Claims, 6 Drawing Sheets

CABINET WALL BED

BACKGROUND OF THE INVENTION

1. Field of Invention

This invention relates to wall beds. More particularly, this invention relates to a cabinet wall bed with a unique locking system for securing the bed within the cabinet.

2. Prior Art

Wall beds and wall-enclosed pieces of furniture are widely used where available space within a room is limited. For example, wall beds are frequently used in hotels, motels, or other such limited space facilities to provide sleeping accommodations without sacrificing floor space. This type of bed is generally provided with a rotation system that allows the bed to pivot upwards from its generally horizontal position to a generally vertical storage position adjacent to or contained within a wall. Because the weight involved in even a medium size bed can be considerable, counterbalancing mechanism is required to make it easier for a person to raise such a wall bed from its horizontal position to its storage position.

Numerous mechanisms have been designed to satisfy this counterbalance requirement. One such prior art arrangement uses torsion bar springs as the main element of the counterbalance mechanism. U.S. Pat. No. 3,877,086 discloses a parallel frame structure having one or a pair of vertically spaced beds mounted for pivotal movement between horizontal and vertical. Torsion bars extend within shafts of the bed and are connected at the outer end to the frame structure. These torsion bars are connected to the bed by mounting members that are movable to vary the lengths of the bars U.S. Pat. No. 3,116,494 discloses another wall bed arrangement with a box spring and mattress which is supported on a wall panel wherein a torsion bar assembly is used to enable the bed to be rotated between its storage and horizontal positions.

Other hidden or wall bed systems use other forms of spring or counterweight mechanisms which operate to support the bed as it is rotated from its horizontal to its vertical position. For example, U.S. Pat. No. 4,736,476 discloses a wall bed mechanism containing a series of springs extending from the lifting assembly to the support frame such that the spring mechanism is placed under tension as the bed rotates into the reclining position and relaxes as the bed rotates into the storage position, thereby assisting a user in storing the bed. Other forms of springs, coil springs and counterweights in wall beds are disclosed, for example, in U.S. Pat. Nos. 416,010, 483,724, 598,841, 640,965, 2,672,624, 3,046,572, 3,097,369 and 3,464,070.

In addition, a counterbalance hinge for pivoting loads which might be useful with wall type beds is disclosed in U.S. Pat. No. 3,999,245.

Another method for supporting a wall bed and for assisting in moving that wall bed from the horizontal to the vertical position is by use of a piston. For example, the use of a gas filled piston for supporting and assisting in the movement of the wall bed is disclosed in a catalogue titled *The Complete Hafele,* published by Hafele America Company, dated July, 1985, page 2.59 through 2.61.

Many devices have been designed to counterbalance wall beds. However, no effective devices have been designed which secure them in their closed position consistently. Generally speaking, there has been little concern about the method of securing wall beds within their cabinets because the tension bar, counterweight or spring mechanism which holds the bed vertical has generally provided sufficient support for the bed. However, in modern hotels or motels more security and safety is required to protect the patrons of the facility from an undesired opening of the wall bed.

Another feature of the wall beds that has remained generally unchanged for many years are the legs which support the wall beds. Conventional hinged or pivot-type legs have been used, for example, in U.S. Pat. No. 640,965, 483,724, 3,097,369 and 3,046,572. The Hafele bed, previously disclosed, uses legs which are retracted from the bed, rotated 90° and hidden within the surface of the bed frame. No attempt has been made to use these supports as anything other than legs for the bed. In addition, these legs as currently designed have no decorative value.

An additional feature not present in prior art wall beds is a simple, inexpensive system to lock the wall beds in a closed position.

Accordingly, it is an object of the invention to disclose a useful, inexpensive, easy to produce cabinet wall bed.

It is an additional object of the invention to disclose a cabinet wall bed whose rotational movement is limited by a counterbalance piston.

It is an additional object of this invention to disclose a unique leg-locking and supporting system which will both support the end of the cabinet wall bed and, in addition, lock the wall bed securely in place in its vertical position.

These and other objects of the invention will be apparent to those knowledgeable in the field from a consideration of the following detailed description, drawings and claims. The description, along with the accompanying drawings, provide a selected example of construction of the device to illustrate the invention.

SUMMARY OF THE INVENTION

In accordance with the present invention, there is provided a cabinet wall bed comprised of (a) a cabinet; (b) a bed frame secured to the cabinet by a pivot means; (c) a counterbalance system secured to the cabinet and the bed frame; and (d) a leg-locking and supporting system for locking the bed frame within the cabinet when the bed frame is closed within the cabinet and for supporting the bed frame when the bed frame is open.

This novel cabinet wall bed provides an attractive, easy to assemble and easy to open and close wall bed for use in areas where floor space is limited, such as apartments, hotels and motels. Its unique leg-locking and bed supporting system uses a single device to both support the bed frame when the bed is open and lock the bed within the cabinet when the bed is in a closed position within the cabinet.

BRIEF DESCRIPTION OF THE DRAWINGS

This invention will now be described with reference to the accompanying drawings in which.

DETAILED DESCRIPTION OF PREFERRED EMBODIMENT

Figure 1:
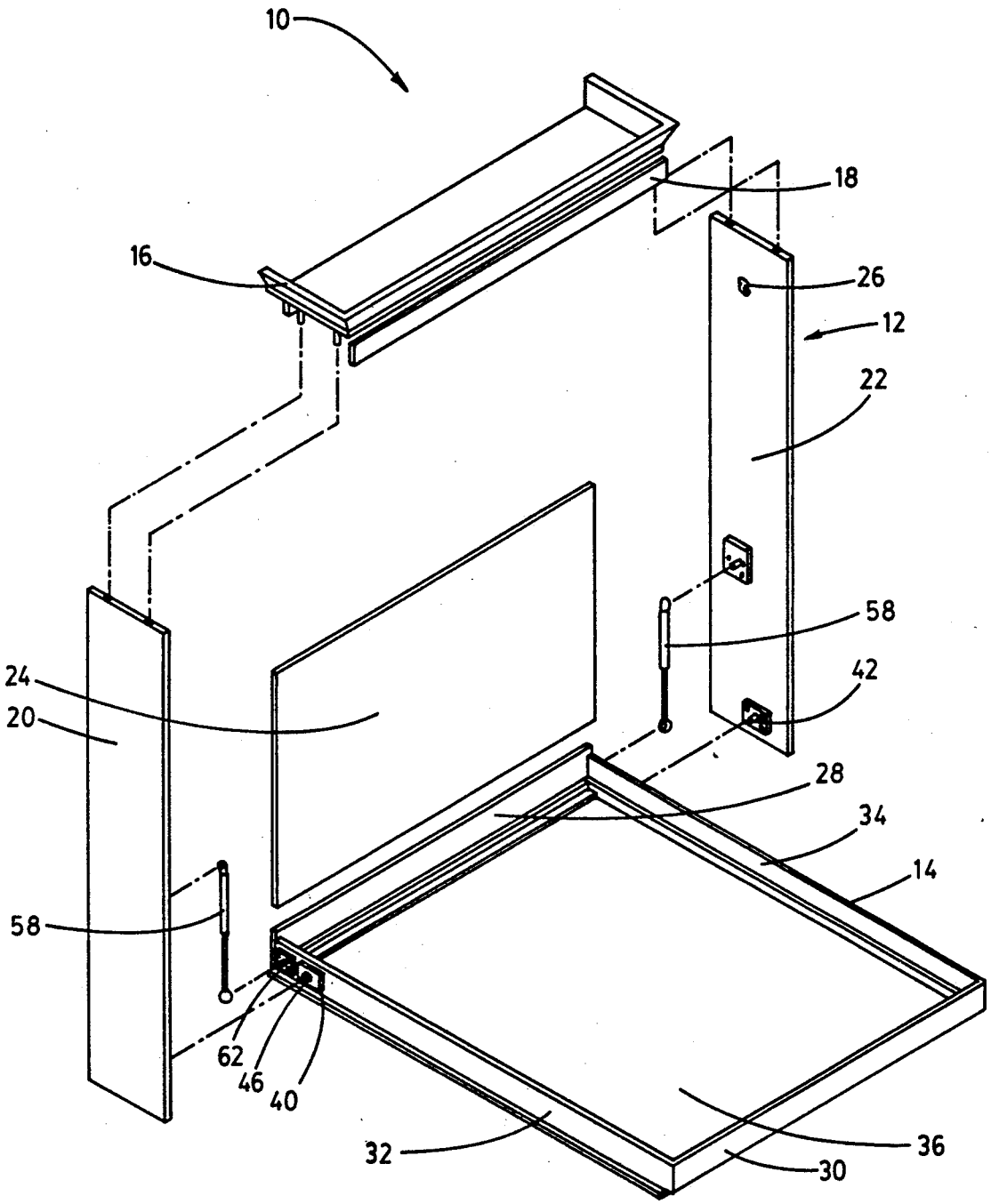
FIG. 1 is an exploded perspective view of the cabinet wall bed with the bed in an open position.
Figure 2:
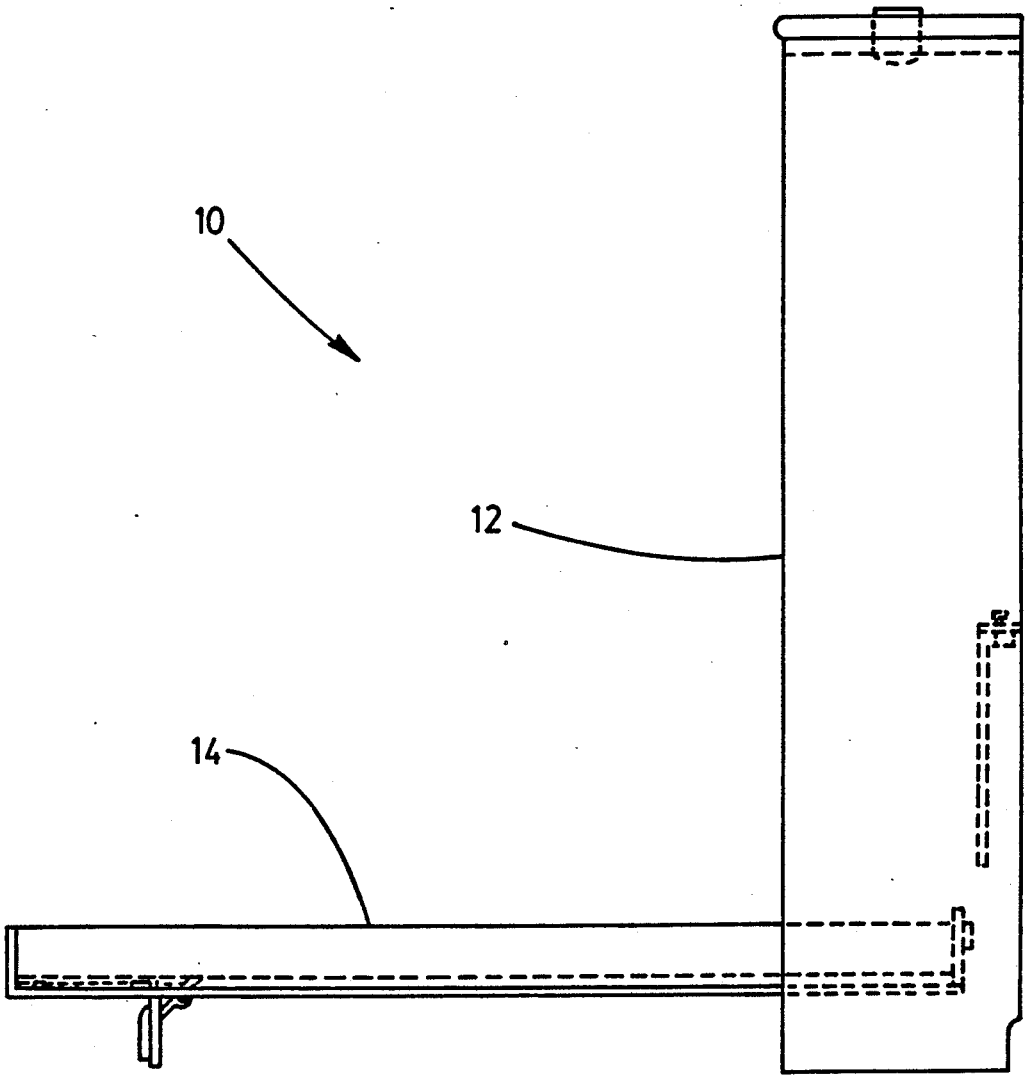
FIG. 2 is a side view of the bed in an open position.

Although the invention is adaptable to a wide variety of uses, it is shown in the drawings for the purpose of illustration as embodied in a cabinet wall bed (10) comprised of a cabinet (12), a bed frame (14) secured to the cabinet by a pivot means, a counterbalance means which is secured to the cabinet and the bed frame and a leg-locking and supporting means secured to the bed frame. See FIGS. 1 and 2.

Figure 3:
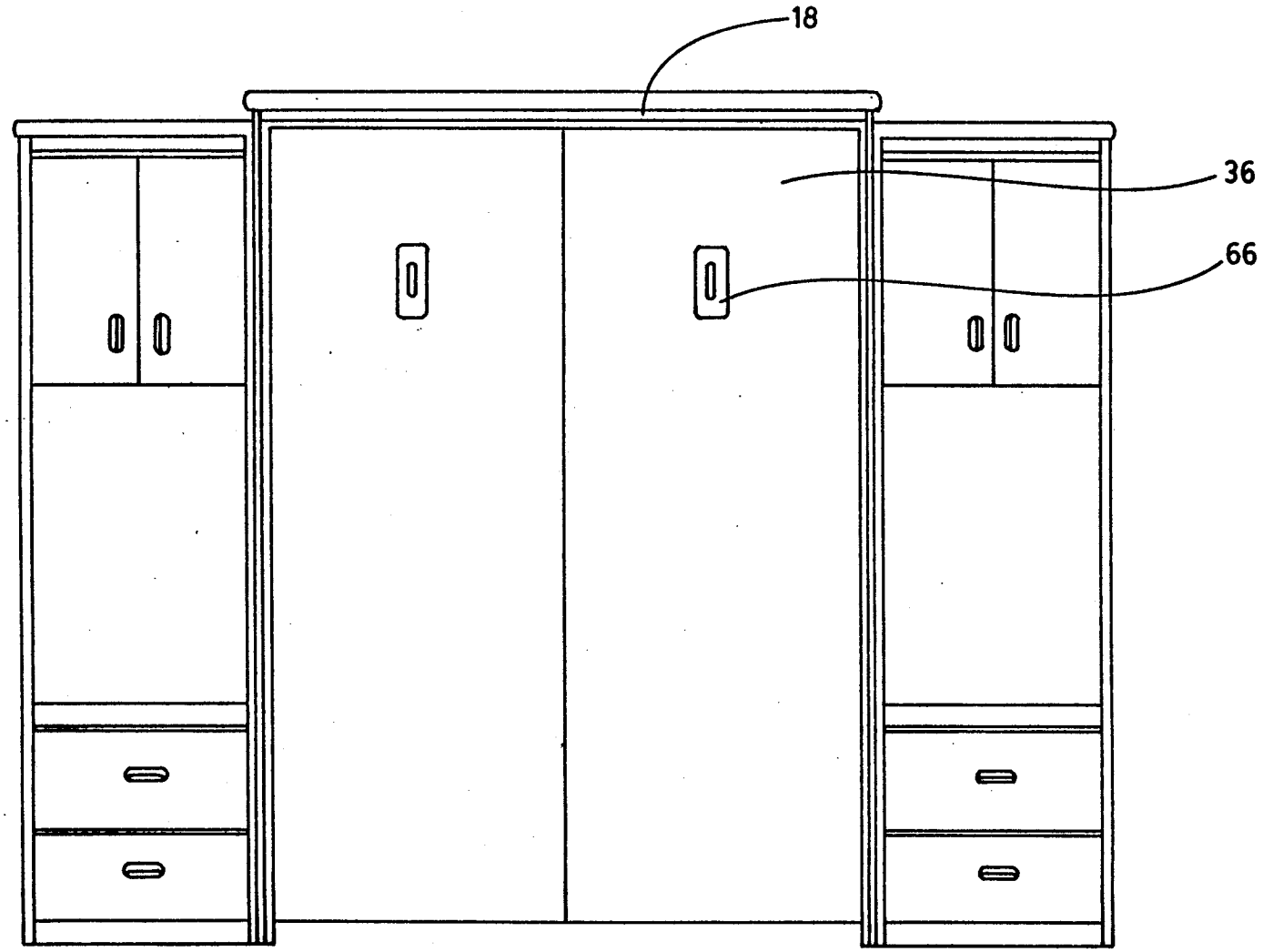
FIG. 3 is a front view of the bed in a closed position.

The cabinet (12) of the cabinet wall bed can be of any size or shape of sufficient width and height to support and enclose the wall bed. Generally, the cabinet is comprised of a top (16), spreader bar (18), two sides (20, 22) and a back (24). The sides and top are generally of sufficient height and depth to permit the bed frame to fit completely and securely within the cabinet, giving the cabinet the appearance of a wardrobe. The spreader bar (18) is preferably a wooden piece which is located below the top of the cabinet running the width of the cabinet. It is about 1 to about 4 inches in height. Its function will be discussed in more detail later. To prevent the bed frame from closing too far, a pair of bed stops (26) are installed in the inside surface of the sides of the cabinet. The type of wood finish and other superficial characteristics of the cabinet can be determined by a manufacturer to suit the needs of the consumer. Shelves, drawers and other conventional elements can be combined with the cabinet for an aesthetically pleasing structure. See FIG. 3.

The bed frame (14) is generally constructed similarly to any conventional bed frame with a back (28), front (30), two sides (32, 34) and a bottom support (36) to support a mattress. The bottom support (36) of the bed frame is preferably manufactured of the same wood materials as is the cabinet to provide a pleasing look to the bed. Specifically, the bottom support (36) of the bed frame is designed to look like the front of a wardrobe with at least two false doors. The bed frame (14) when in a closed position fits within the cabinet to make the cabinet wall bed (10) resemble an upright cabinet. When the bed frame (14) is in a closed position, at least two of the false doors have handles (38) on them. See FIG. 3.

The bed frame (14) and cabinet (12) are constructed of the same type of material as is commonly used for furniture. In fact, one of the advantages of this cabinet wall bed (10) over conventional wall beds is the ability to use aesthetically pleasing woods to form not only the surface of the cabinet when the cabinet wall bed is in the closed position, but the sides (20, 22) of the cabinet when the cabinet wall bed is in the open position.

Figure 4:
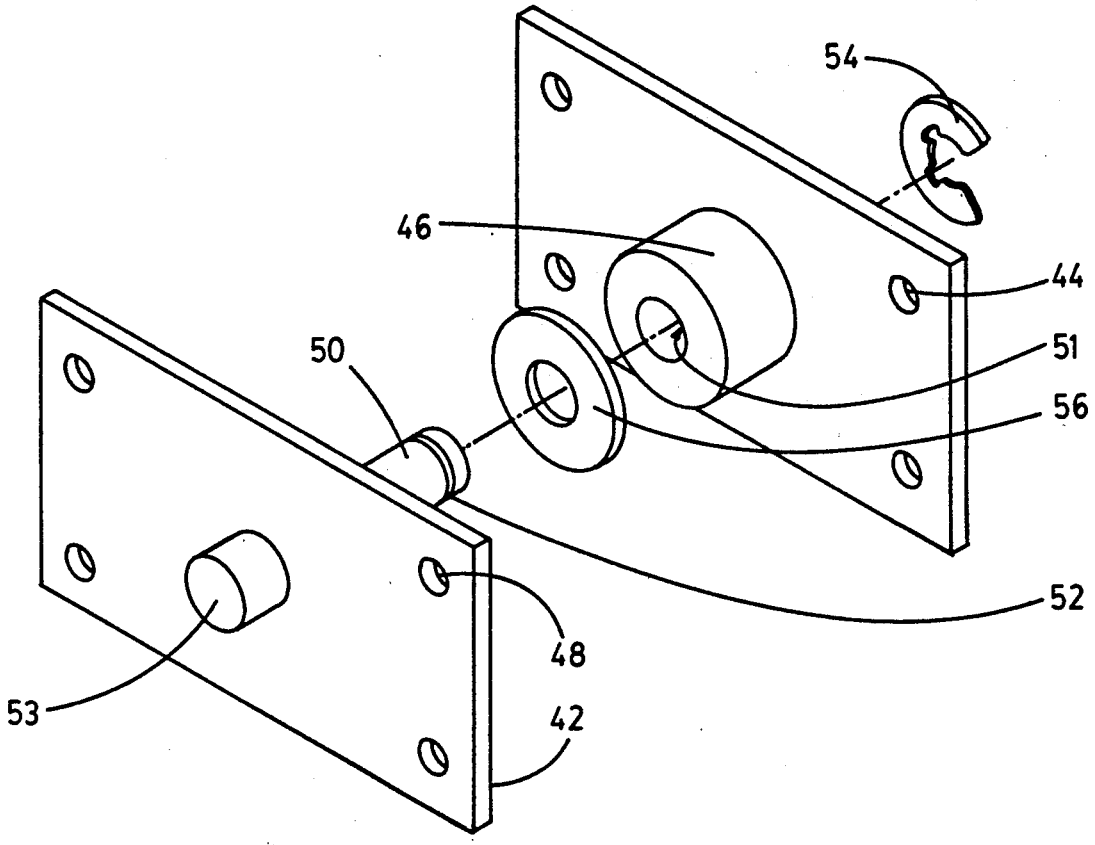
FIG. 4 is an exploded view of the pivot system.

The bed frame (14) is secured within the cabinet (12) by bracket means which preferably are comprised of a pair of bed frame joining brackets (40) secured to each side of the bed frame and a pair of cabinet joining brackets (42) secured to the inside of the sides of the cabinet. See FIGS. 1 and 4. The bed frame joining brackets (40) are secured to the insides of the sides of the bed frame and are generally a rectangular flat plate with openings (44) for securing them with screws to the inside surface of the sides of the bed frame. In the middle of each bracket is a tubular extension piece (46), extending away from the surface of the bracket about ¼ to about 1½ inches. This tubular extension piece (46) has an opening (51) running the entire length of the tubular extension piece which has an inner diameter of about ¼ to about one inch. This tubular extension piece (46) will pass through the side of the bed frame and project to the outside surface of each side of the bed frame. See FIG. 1.

Secured to the inside portion of each side of the cabinet is the cabinet joining brackets (42). Each bracket is comprised of a generally flat rectangular metal piece with openings (48) for securing it to the inside surface of the cabinet a projecting pin (50) and a supporting pin (53). This cabinet joining bracket contains a projecting pin (50) which is slightly smaller in diameter than the opening (51) in the tubular extension piece of the bed frame joining brackets (40). This projecting pin (50) is at least about ½ of an inch longer than the length of the opening (51) in the tubular extension piece and thus projects through the cabinet frame joining bracket. See FIG. 4.

Projecting out from the opposite surface of the cabinet joining bracket (42) from the projecting pin (50) is the supporting pin (53). The supporting pin is secured in an opening drilled in the sides of the cabinet to provide additional support for the cabinet joining bracket (42). Preferably, the supporting pin is approximately the same diameter as is the projecting pin (50) but only ¼ to about 1 inch in length.

To prevent the two portions of the joining bracket from disengaging, in a preferred embodiment, a scribed groove (52) is provided in the surface of the projecting pin (50) as it protrudes through the inside surface of the bed frame joining bracket to permit an E-clip (54) to be inserted in the scribed groove (52). In a preferred embodiment placed over the projecting pin (50) of the cabinet frame joining bracket between the end of the tubular projection (46) and the flat surface of the cabinet frame joining bracket is a nylon or teflon-type washer (56) to reduce the noise of rotation and to provide easier rotation for the bracket.

Figure 5:
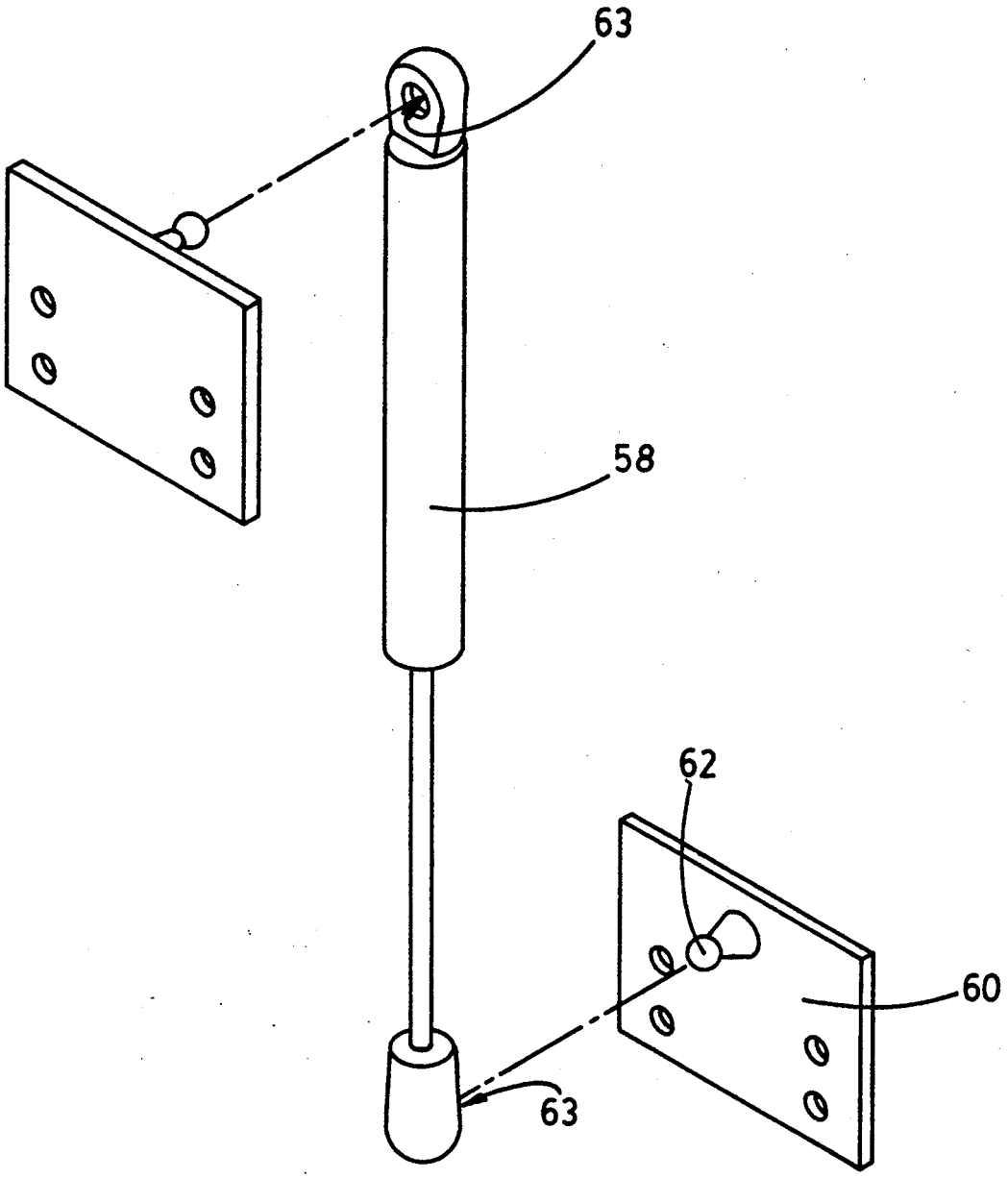
FIG. 5 is an exploded view of piston mechanism.

To permit the easy raising and lowering of the bed frame within the cabinet, there is secured to the inside surface of the side of the cabinet and also to the bed frame on each side of the bed frame a counterbalance piston (58). See FIG. 1. In a preferred embodiment each of the counterbalance pistons is a gas filled piston, similar in design to those disclosed in the Hafele advertisement. These pistons are secured to the bed frame (14) by a bed frame pivot bracket (60) which preferably has a ball mounted end (62) which fits within a ball receiving end (63) which is an element of each end of the piston. Secured at the other end of the piston is a similar ball receiving end which will receive a similar projection ball mounted end on a cabinet frame pivot bracket which is secured to the inside surface of the cabinet frame. See FIG. 5. As the bed frame is rotated on the joining brackets, the pistons permit the bed frame (14) to be raised and lowered without the use of excessive force. The size and shape of the pistons, as well as the location of the piston brackets, will depend on many factors including the weight and size of the bed. The location of the pistons can be adjusted to balance properly the bed frame within the cabinet.

Figure 6:
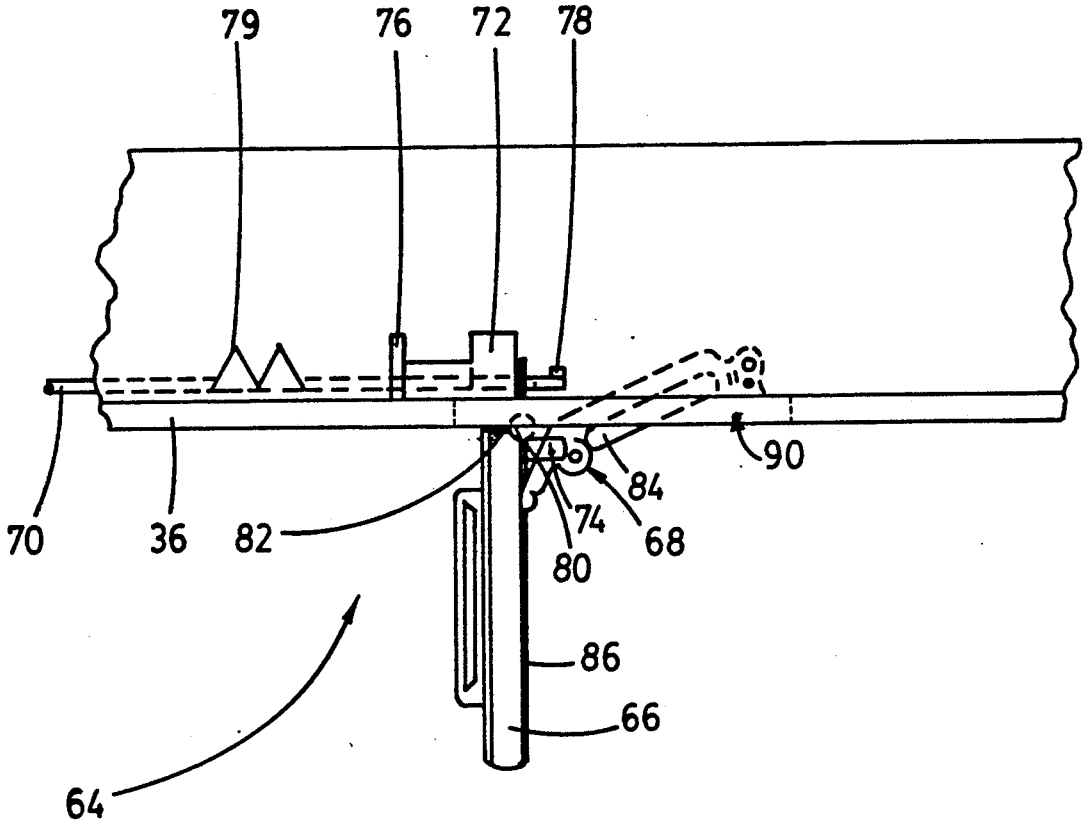
FIG. 6 is an exploded view of the leg-locking and supporting device.

As previously stated, secured to the bottom of the bed frame are at least two leg-locking and support means. See FIG. 6. Preferably these are leg-locking and support units (64) are comprised of a combined handle and leg (66), a spring loaded leg support (68), a locking bar (70), an angle bar (74) to engage the locking bar, a locking bar guide (76), a locking bar end cap (78), supports (72) for the locking bar and one or a pair of spring clips (79). These locking and support units (64) are unique devices which perform a number of functions. When the bed frame (14) is in a horizontal position these leg-locking and supporting units (64) will rotate down on the leg hinge and rest against the floor to support the bed frame.

The combined handle and leg (66) is secured to the bottom of the bed frame by a conventional leg hinge (80) with a pad (82) on the top surface of the combined handle and leg (66). The combined handle and leg (66) is constructed of the same high quality wood as the cabinet to provide a pleasing appearance.

The spring loaded leg support (68) is of unique construction containing a compression spring support (84), a backplate (86) secured by the conventional leg hinge (80) to the back portion of the hinge. This backplate (86) is secured to the inside back of the combined handle and leg (66). The back portion of the hinge is secured inside the bottom support (36) of the bed frame to one of the supports (72) for the locking bar, projecting through an opening (90) in the bed frame. See FIG. 6. The locking bar (70) rests within the pair of supports (72) for the locking bar (70) and a locking bar guide (76) secured to the inside surface of the bottom support of the bed frame. The locking bar (70) is free to move within the supports (72) for the locking bar. The end of the locking bar runs next to the extension of the back plate running inside an opening (90) in the bed frame. When the bed frame is rotated to the vertical position, the leg-locking and supporting unit (64) not only assists in the movement up and down of the bed frame but will lock the bed frame closed by interaction between the locking bar (70) of the leg-locking and supporting unit and the spreader bar (18) which prevents the bed frame from downward rotation until the locking bar is withdrawn.

The angle bar (74) is secured onto the back plate (86) near the inside top of the combined handle and leg (66). The angle bar (74) moves up into the opening (90) in the bed frame when the combined handle and leg is closed. The angle bar (74) strikes the cap (78) on the end of the locking bar (70) and projects it upward through the supports (72) through an opening (not shown) in the front (30) of the bed frame. The locking bar (70) is prevented from excess movement by the interaction of the cap (78) on one end of the locking bar with on of the locking bar supports (72)and the spring clips (79) on the other side of the locking bar supports which restrict the downward movement of the locking bar (70) when the combined handle and leg are opened.

In operation, when the bed frame (14) of the cabinet wall bed (10) is closed, the leg-locking and supporting unit (64) is opened which drops the locking bar (70) below the level of the spreader bar (18) and permits the bed frame (14) to be rotated downward on its cabinet joining brackets (42) and bed frame joining brackets (40). The counterbalance piston (58) prevents the bed frame (14) from dropping too rapidly. As the bed frame (14) approaches the ground, the combined handle and legs (66) of the leg-locking supporting unit (64) rotate downward on their leg hinge (80) pressed by the compression spring support (84) to provide a secure support for the bed frame. When the bed frame (14) is then rotated back to the vertical position by the interaction of the bed frame and cabinet joining brackets (42) and the combined handle and leg (66) is forced shut, the angle bar (74) pushes the locking bar (70) upward through the opening in the front (30) of the bed frame to securely hold the bed frame shut.

I claim:

1. A cabinet wall bed comprised of:

(a) a cabinet;

(b) a bed frame secured to the cabinet by a pivot means wherein there are secured to the inside of the bed frame a locking bar guide and there is secured to one end of the locking bar guide a locking bar end cap and attached to the locking bar are spring clips;

(c) a counterbalance means for counterbalancing the bed frame within the cabinet secured to the cabinet and the bed frame; and (d) a leg-locking and supporting means secured to the bed frame for locking the bed frame within the cabinet when the bed frame is closed within the cabinet and for supporting the bed frame when the bed frame is open wherein the leg-locking and supporting means is comprised of a combined handle and leg secured to the bottom of the bed frame by a leg-locking and supporting hinge, a locking bar, a compression spring support and an angle bar.

2. A cabinet wall bed comprised of:

(a) a cabinet;

(b) a bed frame secured to the cabinet by a pivot means wherein the pivot means is a first joining bracket containing a tubular opening and a second joining bracket containing a projecting pin which will fit within the tubular opening of the first joining bracket, wherein the projecting pin contains a scribed groove, wherein said projecting pin projects through the tubular opening of the first joining bracket, wherein an E-clip is inserted in the scribed groove to prevent the projecting pin from being easily removed from the bed frame joining bracket, wherein there are secured to the inside of the bed frame a locking bar guide, and wherein there is secured to one end of the locking bar guide a locking bar end cap and attached to the locking bar are spring clips;

(c) a counterbalance means for counterbalancing the bed frame within the cabinet secured to the cabinet and the bed frame; and (d) a leg-locking and supporting means secured to the bed frame for locking the bed frame within the cabinet when the bed frame is closed within the cabinet and for supporting the bed frame when the bed frame is open.

* * * * *